United States Patent [19]

Kaup et al.

[11] Patent Number: 4,466,871

[45] Date of Patent: Aug. 21, 1984

[54] METHOD FOR ELECTROPHORETIC ENAMELING

[75] Inventors: Friedel Kaup, Gutersloh; Heinrich Warnke, Harsewinkel, both of Fed. Rep. of Germany

[73] Assignee: Miele & Cie. GmbH & Co., Gutersloh, Fed. Rep. of Germany

[21] Appl. No.: 547,766

[22] Filed: Nov. 1, 1983

Related U.S. Application Data

[63] Continuation-in-part of Ser. No. 382,583, May 27, 1982, abandoned.

[30] Foreign Application Priority Data

May 30, 1981 [DE] Fed. Rep. of Germany ..... 3121667

[51] Int. Cl.[3] ..... C25D 13/02; C25D 13/10

[52] U.S. Cl. ..... 204/181 N

[58] Field of Search ..... 204/181 N

[56] References Cited

U.S. PATENT DOCUMENTS

| | | | |
|---|---|---|---|
| 3,962,059 | 6/1976 | Kaup et al. | 204/181 N |
| 4,085,021 | 4/1978 | van der Vliet | 204/181 N |

*Primary Examiner*—Howard S. Williams

*Attorney, Agent, or Firm*—Collard, Roe & Galgano

[57] ABSTRACT

An electrophoretic coating method, including the steps of electrophoretically coating an anodic workpiece with enamel in an enamel slop composed of a watery suspension. At least one substance is added to the enamel slop which is enamel compatible and which emits electrons in the region of the anodic workpiece. Such compounds sometimes known as reduction agents are, for example, nitrite, sulfite, hypophosphite, cyanide, bromide and iodide.

4 Claims, 2 Drawing Figures

METHOD FOR ELECTROPHORETIC ENAMELING

This is a continuation-in-part application of co-pending application Ser. No. 382,583 filed May 27, 1982, now abandoned, entitled "METHOD FOR ELECTROPHORETIC ENAMELING".

The present invention relates to a method for electrophoretic enameling and, more particularly, it relates to an improved method of electrophoretic enameling which results in a smoother and more even enamel coating.

In electrophoretic enameling the suspended enamel particles are deposited on the anodic workpiece by the effect of an electric field. This depositing process, due to the high ion content of the watery suspension, generally referred to as an enamel slop, is combined with strong electrolyte reactions. The composition of such enamel slops are generally known from the prior art, see, for example U.S. Pat. No. 4,085,021, to van der Vliet, granted Apr. 18, 1978, where such suspensions are described at column 1, lines 1 to 13, and column 2, lines 30 to 33. In such prior art enameling, very strong undesirable reactions occur on the surface of the workpiece, as the enamel particles are deposited during the current flow, which are expressed in the form of gas developments and oxidation products of the carrier material. Thus, the resulting enamel layer is porous and discolored due to the oxidation products of the workpiece which predominantly consist of iron.

A galvanizing method is known and is described in DE-PS No. 20 45 265, which substantially eliminates these disadvantages. However, a significant disadvantage of this method, which operates well, is that the galvanization coat must be applied very thin and very evenly. As a result of this requirement the equipment installation for this is larger, with a concomitant increase in investment cost and resulting expense to the consumer.

It is, therefore, an object of the present invention to reduce or eliminate these known disadvantages and to provide an electrophoretic method whereby acceptable enamel coatings result without galvanization or with an even thinner or uneven galvanization of the carrier material than required in the prior art galvanizing method.

For this purpose, the enameling method according to the present invention is characterized by the addition of substances to the inorganic watery suspension or enamel slop which are enamel compatible and which emit electrons in the region of the anodic workpiece.

In accordance with the present invention, oxidation of the workpiece surface is prevented by substances which are admixed to the inorganic enamel slop and which become electron emitters in the region of the anodic workpiece during the deposition of the enamel. Preferably, these substances are compounds which are oxidizable and therefore act as reaction agents under certain conditions. Such compounds are sometimes known as reduction agents. Compounds of this general type are, for example, nitrite, sulfite, hypophosphite, cyanide, bromide, iodide (organic reduction agents). It has been found that these substances may be used alone or in combination with one another. However, with respect to bromide and iodide it is necessary to be cautious and take into consideration that halogens always behave negatively with respect to hydrogen and other metals, but positively with respect to oxygen, one, three, five or seven valence.

The effect of potassium bromide as an additive to the inorganic enamel slop is dramatically demonstrated below where tests utilizing concentrations ranging from 0.5 to 1.5 grams per liter of enamel slop are described. Similar results are also obtainable with sodium bromide.

Other objects and features of the present invention will become apparent from the following detailed description considered in connection with the accompanying drawings, in which.

Referring now in detail to the drawings, the test plates shown are galvanized in the lower area prior to electrophoretic coating with enamel, but not on the upper area. During the testing, the concentration of potassium bromide was increased from 0 to 2.0 grams per liter.

When making the inorganic enamel slop, care was taken to ensure that oxidizable substances were not initially present in the slop, for example, by using distilled water.

Figure 1:
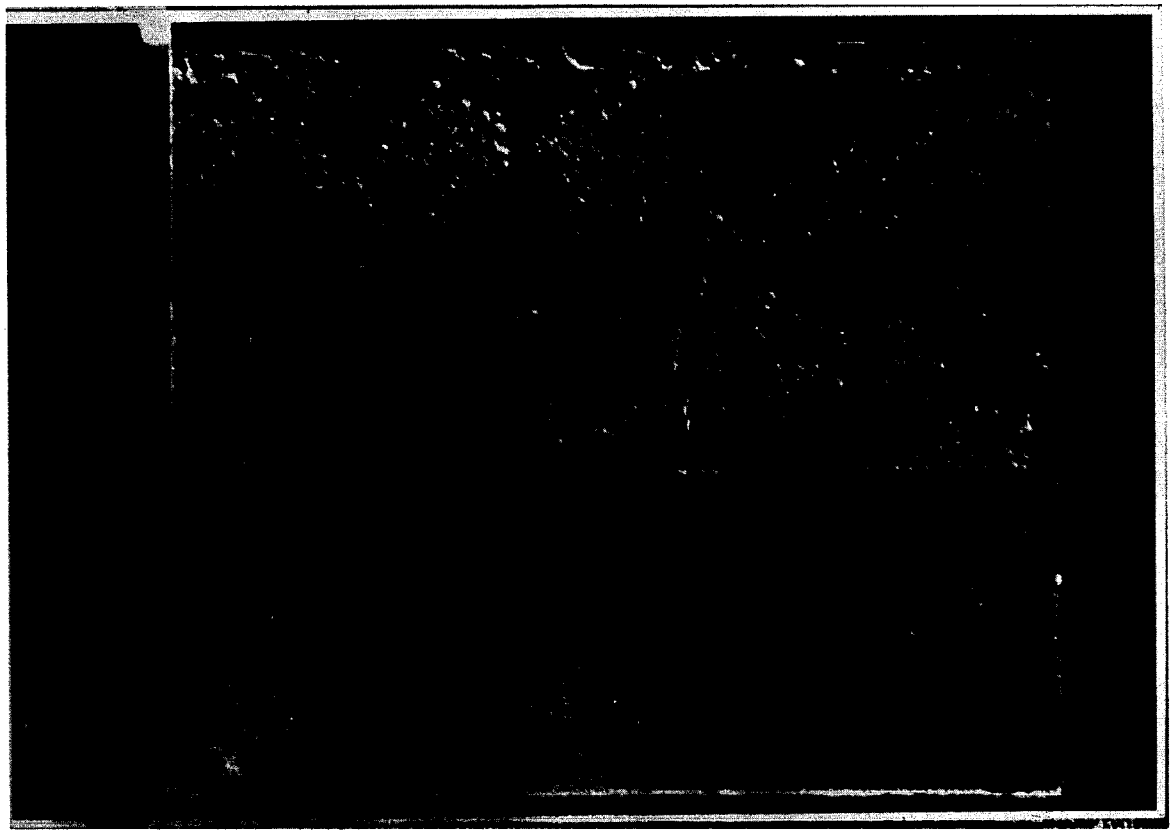
FIG. 1 is a photograph of a coated and dried but non sintered test plate which had been galvanized in the lower area in accordance with the method known from DE-PS No. 20 45 265, before coating with enamel where the deposited enamel layer is smooth and free from pores. In contrast, the upper area of the test plate has not been galvanized and is shown to be porous after the enameling process.

When no potassium bromide is contained in the slop (FIG. 1 and FIG. 2, 1st plate upper left), one can clearly see the mode of operation of the zinc. The enamel coat is flawless only in the area of galvanization.

Figure 2:
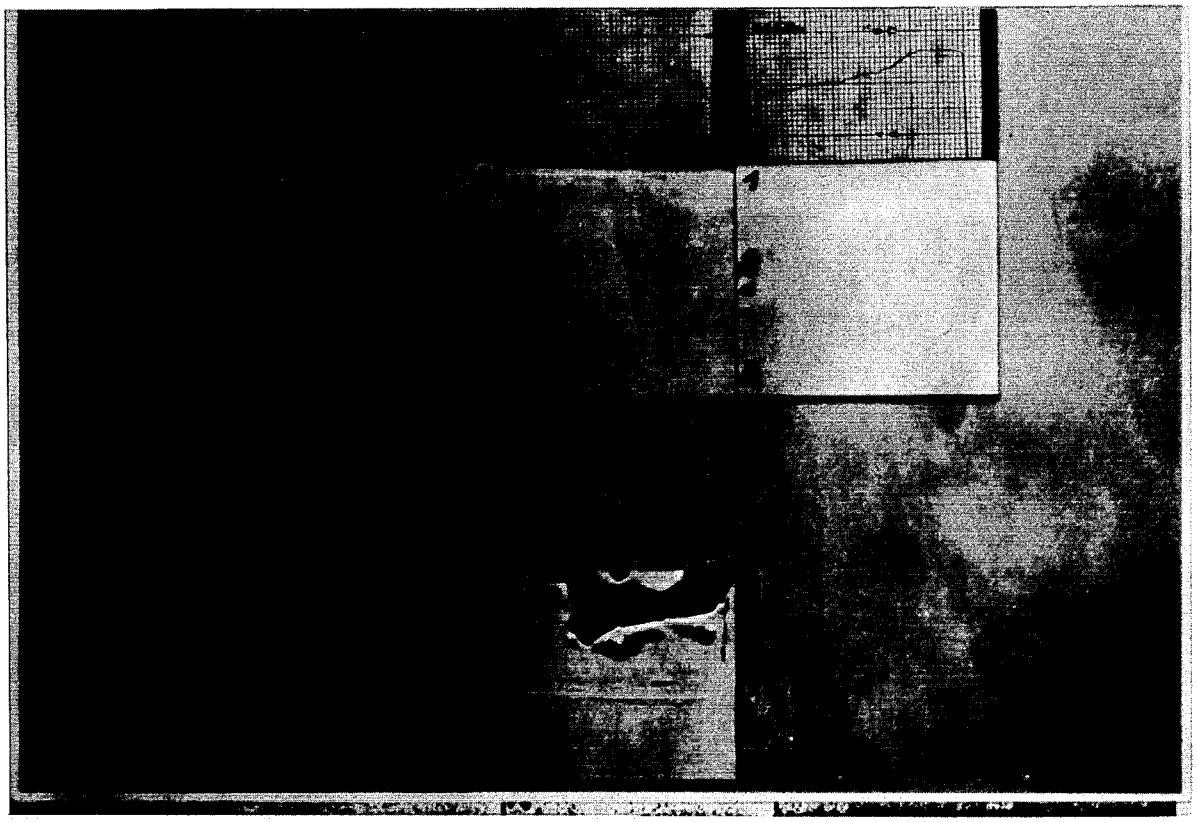
FIG. 2 is a photograph of 5 enameled test plates on which the effect of different concentrations of potassium bromide in the enamel slop are shown.

Practically no difference is present after enameling between the galvanized and ungalvanized portions of the test plates of FIG. 2 where the concentration of potassium bromide is 0.5 to 1.5 grams per liter of slop. At a concentration of 2.0 grams of potassium bromide per liter of slop, one can see a contraction of the enamel on the ungalvanized face. The recorded test was performed with a titanium-white enamel suitable for direct enameling. The optimum concentration of the oxidizable substance is dependent on the type of enamel, the slop composition and the substances employed, as had been shown in numerous tests.

Thus, by the method according to the present invention, the coating with enamel is performed evenly and without any bubble formation on the workpiece, even when the zinc coating is reduced or uneven. No additional method step is necessary. Merely with the addition of additives to the enamel slop the possibility is provided to operate with reduced zinc coats or to eliminate galvanization altogether. These are additives which, on the one hand, are compatible with the enamel and, on the other hand, are able to emit electrons so as to prevent undesirable reactions on the anodic poled workpiece either totally or partially.

What is claimed is:

1. An electrophoretic coating method, comprising the steps of:

electrophoretically coating an anodic workpiece with enamel in an inorganic enamel slop composed of a watery suspension; and adding at least one substance to said enamel slop which is enamel compatible, and which emits electrons in the area of the anodic workpiece, said substance being selected from the group consisting of bromide or iodide.

2. The method of claim 1, wherein said substance added to said enamel slop comprises potassium bromide.

3. The method of claim 2, wherein between 0.5 to 1.5 grams of potassium bromide per liter is added to said inorganic enamel slop.

4. The method of claim 1, wherein sodium bromide is added to said inorganic enamel slop.

* * * * *